United States Patent [19]

Nakagawa et al.

[11] 4,192,641

[45] Mar. 11, 1980

[54] COMBUSTION CONTROL APPARATUS

[75] Inventors: Sumio Nakagawa, Tokyo; Toshio Tanaka, Toride; Kenji Todo, Yanai, all of Japan

[73] Assignee: Hitachi, Ltd., Japan

[21] Appl. No.: 865,486

[22] Filed: Dec. 29, 1977

[30] Foreign Application Priority Data

Jan. 10, 1977 [JP] Japan ..... 52/821

[51] Int. Cl.[2] ..... F23N 5/24; F23N 5/00

[52] U.S. Cl. ..... 431/15; 431/31; 431/71; 431/73

[58] Field of Search ..... 431/71, 31, 46, 73, 431/15, 14

[56] References Cited

U.S. PATENT DOCUMENTS

| | | | |
|---|---|---|---|
| 3,324,927 | 6/1967 | Staring | 431/15 |
| 3,715,180 | 2/1973 | Cordell | 431/31 |
| 3,872,320 | 3/1975 | Ouskewicz, Jr. | 431/69 X |

*Primary Examiner*—Carroll B. Dority, Jr.
*Assistant Examiner*—Lee E. Barrett
*Attorney, Agent, or Firm*—Craig and Antonelli

[57] ABSTRACT

Disclosed is a combustion control apparatus of digital type, in which a fault is warned of unless ignition resumes in a predetermined time after the start of igniting operation in the reignition when fuel flaming is extinguished during combustion. The predetermined time is called safety time and the combustion control apparatus can exactly obtain such a required time or period as the safety time. With such a digital type combustion control apparatus, the safety timer for establishing the safety time comprises flip-flops adapted to count reference clock pulses. In this apparatus, the circuit for generating the reference clock pulses is set and reset by the flame extinction signal to synchronize the clock pulses and the flame extinction signal so that the safety time may be free from error. This concept can be applied to determine the prepurge time.

27 Claims, 6 Drawing Figures

COMBUSTION CONTROL APPARATUS

BACKGROUND OF THE INVENTION

This invention relates to a digital type combustion control apparatus and more particularly to an improvement in the time for controlling the start of reignition operation when fuel flaming is extinguished during combustion in such an apparatus.

In a combustion control apparatus for a combustion system which generates a hot blast or heated water by burning gas fuel or liquid fuel such as kerosene, before combustion operation is usually performed a prepurge operation, i.e. operation to remove the residual fuel in the combustion system, by driving a blower. Then the fuel is supplied by actuating the fuel supply valve to open and the igniting operation is continued for a certain time by energizing the ignitor so that the supplied fuel may be burned. In this case, if fuel is not burned for a predetermined time after the start of the ignition operation, a warning apparatus operates to indicate that a fault has taken place and to stop the entire operation of the combustion system. In case where fuel flaming is extinguished for some reason or other while fuel has been burning so far, after the completion of igniting operation, the reignition operation is performed after the combustion control cycle has been started with the prepurge operation (prepurge return method) or the reignition operation starts without the prepurge operation (ignition return method). The warning apparatus is operated, irrespective of the kind of methods, unless fuel flaming is resumed in a predetermined time, i.e. safety time, after the start of reigniting operation. This invention is applicable to both of the methods. Also, the term "reignition operation" includes the same action in both of the methods. In the conventional combustion control apparatus of digital type, the timer for measuring the safety time usually comprises flip-flops for counting reference clock pulses. Since the reference clock pulses are not synchronized with a signal indicating that fuel burning is extinguished (hereafter referred to for convenience as flame extinction signal), then an error equal to one period of the clock signal at most is incurred in the safety time. In the case where the safety time is selected to be relatively short a relatively large error will possibly be caused. For example, a combustion apparatus with gas fuel according to the direct ignition method or ignition return method has a safety time of 2 seconds and if in this case the period of the reference clock signal is one second, the error in the sense mentioned above becomes considerably large. Accordingly, the effective portion of the safety time is shortened, the probability of ignition during the safety time decreases and the chance of failure in ignition increases.

Even in the case where a long safety time is used, the same problem will be caused if the period of the reference clock pulse signal is lengthened.

Moreover, in the prepurge method where prepurge operation is performed prior to the ignition operation after fuel burning is extinguished, there is caused a problem in that the time of prepurge operation or prepurge time is shortened.

SUMMARY OF THE INVENTION

One object of this invention is to eliminate such drawbacks as described above.

Another object of this invention is to prevent an error in the safety time caused due to the asynchronism of the flame extinction signal with the reference clock pulses for the safety timer, by synchronizing the signal with the pulses.

According to this invention, which has been made to attain the above objects, there is provided a digital type combustion control apparatus in which the reference clock pulse is reset each time the flame extinction signal is generated, whereby the flame extinction signal is synchronized with the reference clock pulses to obtain an exact control time.

DETAILED DESCRIPTION OF THE INVENTION

For a better understanding of this invention, description will be made prior to that of this invention, of a conventional digital combustion control apparatus employing the ignition return method wherein when fuel flaming is extinguished during combustion, the reignition operation is immediately performed without prepurge operation.

Figure 1:
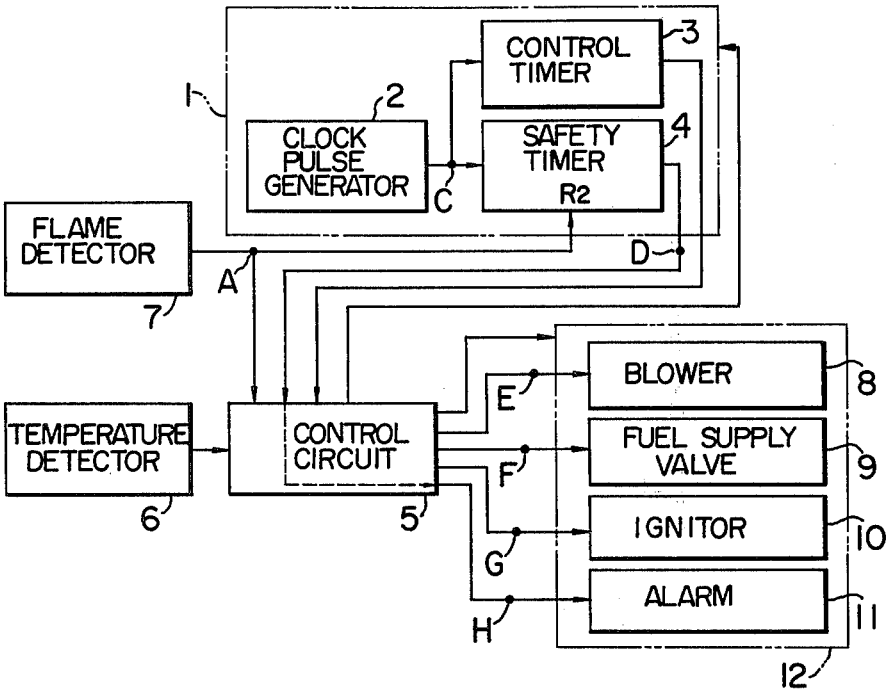
FIG. 1 PRIOR ART
FIG. 1 is a block diagram of a conventional combustion control apparatus of digital type.

FIG. 1 shows a conventional digital combustion control apparatus, in which reference numeral 1 indicates a timer circuit for generating a required timing, consisting of a reference clock pulse generating circuit 2, a control timer 3 for generating the operating timing of external combustion equipment by receiving the reference clock pulses from the circuit 2 and a safety timer for establishing a safety time for reignition operation by receiving the reference clock pulses. The above mentioned circuit 2 and timers 3 and 4 are well-known circuits and each of the timers 3 and 4 may be constituted of flip-flops connected in series. The output signals from the timers 3 and 4 are supplied to a control circuit 5, which further receives the output signal of a temperature detecting circuit 6 and the output signal of a flame detecting circuit 7 and therefore indicates that fuel is burning. The control circuit 5 in turn delivers various output signals at selected points in time. The outputs of the control circuit 5 are supplied to an external combustion system 12 which includes a combustion blower 8, an electromagnetic fuel supply valve 9, an ignitor 10 and an alarm 11. Also, one of the outputs of the control circuit 5 is supplied to the timer circuit 1. The output of the flame detecting circuit 7 is supplied also to the reset terminal R2 of the safety timer 4. The arrows in the figure indicate the directions of flow of the signals.

Figure 2:
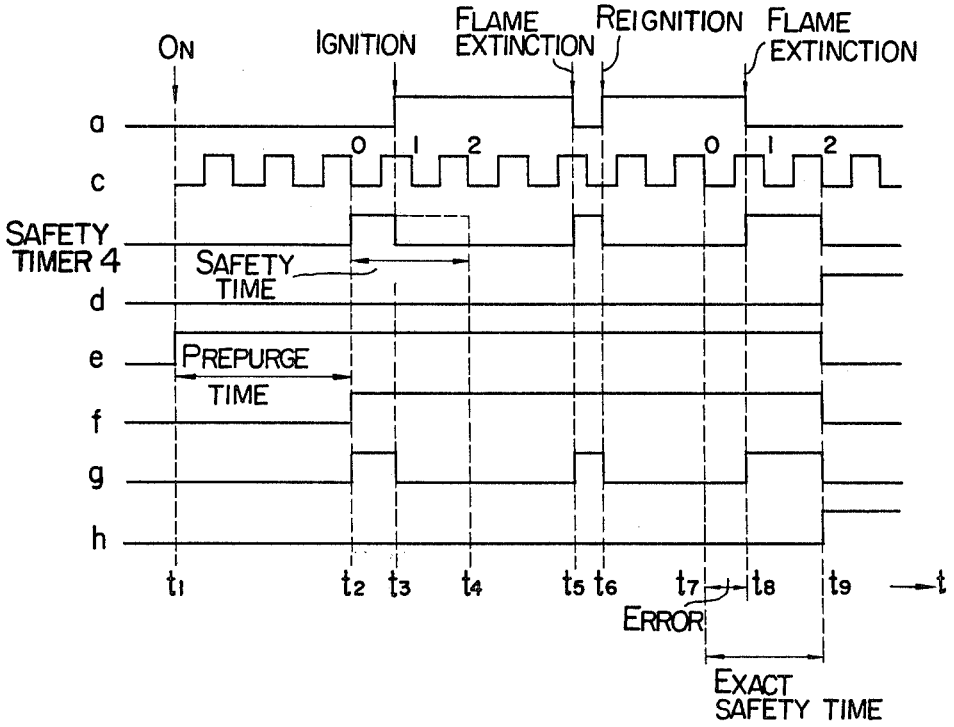
FIG. 2 PRIOR ART
FIG. 2 shows waveforms useful in explaining the operation of the circuit shown in FIG. 1.

The operation of the combustion control apparatus having such a structure will be described with the aid of the operating waveforms appearing at points A—H in the circuit shown in FIG. 1. The waveforms a to h shown in FIG. 2 are respectively derived at the points A to H. The waveform on the third line of FIG. 2 illustrates the inner operational status of the safety timer 4. When a drive start signal is delivered from the circuit 6 to the control circuit 5 at a point in time $t_1$, as indicated by "ON", the signal e appearing at the point E becomes high and actuates the blower 8 to operate to perform the prepurge operation by which the residual gas in the combustion apparatus is purged away. Simultaneously with the start of the prepurge operation, the reference clock pulse generating circuit 2 starts its operation so that the control timer 3 begins to frequency-divide the reference clock pulse signal c to start a predetermined measurement of time. After the time required for the prepurge operation (hereafter referred to as prepurge time) has lapsed, the outputs f and g produced by the control circuit 5 in accordance with the instruction of the control timer 3 actuate the electromagnetic valve 9 and the ignitor 10 to operate at a point in time $t_2$ (see FIG. 2) and at the same time the safety timer 4 is actuated to start to frequency-divide the reference clock pulse signal c. If the ignition operation is completed at a point in time $t_3$ within the predetermined period from $t_2$ to $t_4$ (hereafter referred to as safety time) the flame detecting circuit 7 produces a signal a indicating that fuel is burning, i.e. a flame signal. This flame signal a is delivered to the reset input R2 the safety timer 4 so that the timer 4 is reset to stop its operation. The flame signal a is also applied to the control circuit 5 so as to end the signal g so that the ignitor 10 stops its operation at $t_3$ (see the waveform g in FIG. 2). Thus, the steady state combustion operation is set up.

If fuel burning is extinguished at a time $t_5$ during the steady state combustion, the safety timer 4 is set by the extinction of the flame signal or a flame extinction signal (see the waveform a in FIG. 2) to start to frequency-divide the reference clock pulse signal c supplied from the reference clock pulse generating circuit 2 so as to generate a predetermined safety time. Simultaneously, the ignitor 10 is started by the signal g from the control circuit 5. If in this case fuel is reignited and flame is detected at a point in time $t_6$, the safety timer 4 is reset at $t_6$ by the flame signal a (FIG. 2) indicating the completion of reignition and at the same time the ignitor 10 is also deenergized. Thus, the combustion system resumes steady state combustion. As shown in FIG. 2, if the flame extinction occurs at a time $t_8$ and reignition fails even at a point in time $t_9$, i.e., even after the safety time has passed no flame is detected, the safety timer 4 produces an alarm signal d which is in turn transferred by the control circuit as an alarm signal h to the alarm 11 to acutate it to shut off all the combustion units included in the external combustion equipment 12.

As shown in this case, since the flame extinction signal (see waveform a in FIG. 2) is asynchronous from the frequency dividing operation of the safety timer 4, an error is caused in the safety time within the period of the reference clock pulse signal. Namely, the safety time, which should be extended from $t_7$ to $t_9$ correctly, is shortened as if it is from $t_8$ to $t_9$. Thus, the actual safety time appears to have been shortened by the error period from $t_7$ to $t_8$. In order to eliminate such an error in the safety time, the flame extinction signal is synchronized with the reference clock pulse signal according to this invention.

This invention will now be described by way of embodiment.

Figure 3:
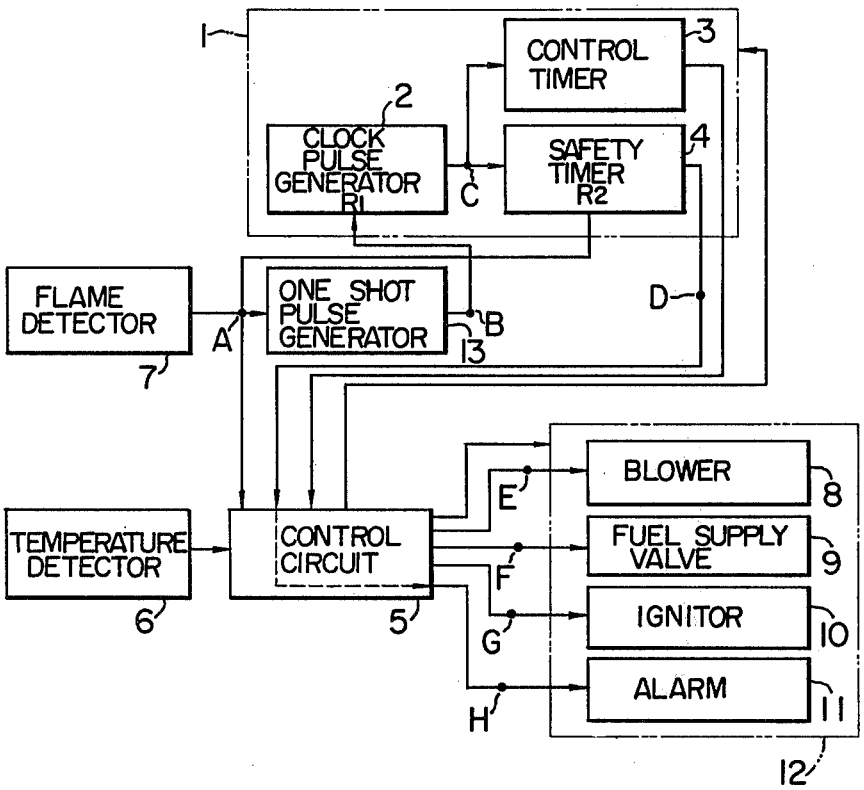
FIG. 3 is a block diagram of a digital type combustion control apparatus as an embodiment of this invention.

FIG. 3 shows in block diagram a combustion control apparatus as an embodiment of this invention. The circuit elements or parts used in common in the circuits shown in FIGS. 1 and 3 are indicated by the same reference numerals and characters. In FIG. 3, the output of the flame detecting circuit 7 is supplied to the reset terminal R2 of the safety timer 4, the control circuit 5 and the reset terminal R1 of the reference clock pulse generator 2 through a one-shot pulse generator 13 which, when triggered, delivers a single pulse having a duration sufficiently short as compared with the period of the reference clock pulse signal. The remaining structure of the circuit in FIG. 3 is the same as that of the circuit in FIG. 1.

Figure 4:
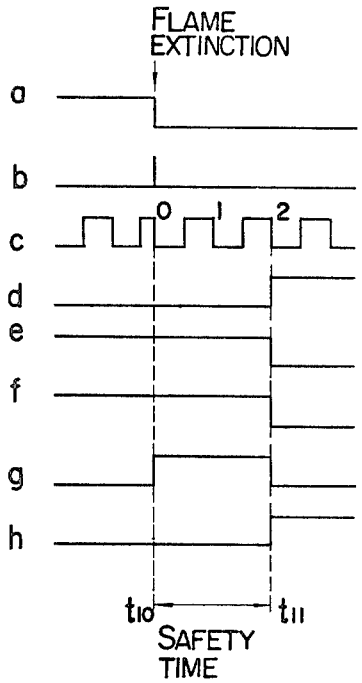
FIG. 4 shows waveforms useful in explaining the operation of the circuit shown in FIG. 3.
Figure 5:
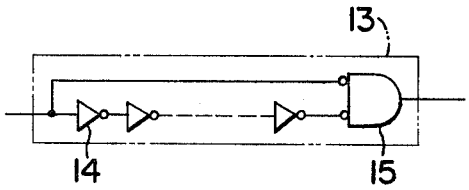
FIG. 5 shows an example of a one-shot pulse generator used in this invention.
Figure 6:
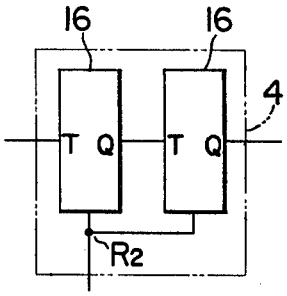
FIG. 6 shows an example of a timer circit used in this invention.

The operation of the combustion control apparatus having such a structure as described above will next be explained with the aid of waveforms a to h shown in FIG. 4, appearing respectively at points A to H in the circuit shown in FIG. 3. The reignition operation performed with success within the safety time is the same as the conventional one and therefore only the case will be described where the reignition operation failed. When fuel flaming is extinguished at a point in time $t_{10}$, the output signal a (see waveform a in FIG. 4) of the flame detecting circuit 7 is shifted from logic level "1" to logic level "0" at the same time as the extinction of flame. In response to the transience of the level from "1" to "0", the one-shot pulse generator 13 delivers a pulse b having a very short duration. FIG. 5 shows a differentiating circuit as one embodiment of the one-shot generator 13, the differentiating circuit consisting of an odd number of inverters 14 and an AND circuit 15. With this circuit 13, a one-shot pulse, i.e. pulse having a duration shorter sufficiently than the period of the clock pulse signal, (waveform b in FIG. 4) appears at the point B at the point in time $t_{10}$, i.e. simultaneously with the extinction of flame. When the one-shot pulse b is supplied to the reset terminal R1 of the reference pulse generating circuit 2, the reference clock pulse generating circuit 2 is once reset at the same time as the extinction of flame and then immediately set to start the generation of the clock pulses. Thus, the reference clock pulse signal c is set at $t_{10}$ to the initial state (point 0 in the waveform c in FIG. 4) and the reference clock pulses c immediately begin to appear from the point 0 as a starting point. If no flame is detected during the safety time, i.e. period from $t_{10}$ to $t_{11}$, an alarm signal d is generated at $t_{11}$. This operation for the alarm has already been described. In this embodiment, if the safety timer 4 is constituted of two flip-flops 16, for example, and if the reference clock pulse signal c has a period of one second, an exact safety time of 2 seconds (waveform d in FIG. 4) can be obtained. In the case where it is required to increase the duration of the safety time, the number of the flip-flops 16 constituting the safety timer 4 may be increased and an exact safety timer will be obtained. It is needless to say that the control timer 3 may have the same circuit configuration as the safety timer 4. The differentiating circuit serving as the one-shot pulse generating circuit 13 may be replaced by, for example, a one-shot multivibrator.

The foregoing description has been given to the combustion control apparatus employing the ignition return method wherein when fuel burning is extinguished during combustion, the reignition operation is immediately performed. However, it is apparent to those skilled in the art that this invention can be effectively applied to the combustion control apparatus employing the prepurge return method wherein when fuel flaming is extinguished during combustion, the recombustion cycle is started with the prepurge operation. Namely, since the flame extinction signal is synchronized with the clock pulses by resetting and setting the clock pulse generating circuit in response to the generation of the flame extinction signal, an error can be prevented from arising during the prepurge time.

As shown in FIG. 2, the signal g to energize the ignitor disappears simultaneously with the generation of the signal a indicating the presence of flame. However, it is apparent that this invention is applicable not only to a combustion system having such a mode of operation as mentioned above but also to other combustion systems wherein the signal to energize the ignitor, after having continued for a given period, is extinguished on conditon that the flame signal is present or where the signal to energize the ignitor continues to exist during the safety time established by the safety timer irrespective of whether the flame signal is present or not.

We claim:

1. A combustion control apparatus of digital type for a combustion system including therein at least a fuel supplying apparatus, an ignitor and an alarm, comprising:

means for generating a reference clock pulse signal;

first timer circuit means connected with said reference clock pulse generating means, for establishing a first predetermined period of time by frequency-dividing said reference clock pulse signal; and control circuit means connected with said first timer circuit means, for receiving at least a first external input signal indicating the presence of flame generated as a result of the ignition of fuel supplied from said fuel supplying apparatus, said control circuit means delivering a first, a second and a third output signals, said first output signal resetting said reference clock pulse generating means in response to the extinction of said first external input signal during a combustion operation and immediately thereafter setting said reference clock pulse generating means to resume its operation, said second output signal setting said first timer circuit means to start the frequency-dividing operation for establishing said first predetermined period of time, and said third output signal actuating said alarm to operate unless said first external input signal arrives within said first predetermined period of time, and stopping the operations of said fuel supplying apparatus and said ignitor included in said combustion system.

2. A combustion control apparatus as claimed in claim 1, wherein said combustion control apparatus further comprises a second timer circuit means connected with said reference clock pulse generating means, for establishing a second predetermined period of time by frequency-dividing said reference clock pulse signal and supplying said second predetermined period of time to said control circuit means, and wherein said control circuit means delivers a fourth output signal to actuate a blower included in said combustion system in response to a second external input signal applied to said control circuit means, then simultaneously delivers said second output signal and a fifth output signal for energizing said ignitor when said second predetermined period of time has lapsed since the start of the generation of said fourth output signal, and then delivers said third output signal unless said first external input signal arrives within said first predetermined period of time.

3. A combustion control apparatus as claimed in claim 2, wherein said control circuit means delivers again said fifth output signal, during the combustion operation in said combustion system, in response to the extinction of said first external input signal which has been so far received by said control circuit means.

4. A combustion control apparatus as claimed in claim 3, wherein said fifth output signal is extinguished in response to the reception of said first external input signal by said control circuit means after said fifth output signal has been delivered.

5. A combustion control apparatus as claimed in claim 3, wherein said fifth output signal is extinguished after the lapse of a predetermined time following the delivery of said fifth output signal, on condition that said first external input signal is present.

6. A combustion control apparatus as claimed in claim 3, wherein said fifth output signal is extinguished at the end of said first predetermined period of time.

7. A combustion control apparatus as claimed in claim 4, wherein said control circuit means delivers a sixth signal to stop the operation of said second timer circuit means in response to the reception of said first external input signal by said control circuit means.

8. A combustion control apparatus as claimed in claim 1, wherin said alarm includes means for indicating the occurrence of a fault in said combustion system when actuated by said third output signal.

9. A combustion control apparatus as claimed in claim 2, wherein said control circuit means delivers a seventh output signal to actuate said fuel supplying apparatus to supply fuel in response to said second external input signal.

10. A combustion control apparatus as claimed in claim 9, wherein said seventh output signal is delivered when said second predetermined period of time has lapsed after the commencement of said fourth output signal.

11. A combustion control apparatus as claimed in claim 10, wherein, in response to the arrival of said second external input signal, said control circuit means simultaneously delivers said fourth output signal, an eighth output signal and a ninth output signal, said eighth and ninth output signals being used to respectively start the operations of said reference clock pulse generating means and said second timer circuit means.

12. A combustion control apparatus as claimed in claim 1, wherein said control circuit means includes therein a circuit for generating a one-shot pulse having a duration sufficiently shorter than the period of said reference clock pulse signal in response to the extinction of said first external input signal during a combustion operation, said one-shot pulse being supplied as said first output signal to said reference clock pulse generating means.

13. A combustion control apparatus as claimed in claim 12, wherein said one-shot pulse generating circuit is a differentiating circuit.

14. A combustion control apparatus as claimed in claim 12, wherein said one-shot pulse generating circuit is a one-shot multivibrator.

15. A combustion control apparatus of digital type including therein at least a fuel supplying apparatus, a blower, an ignitor and an alarm, comprising:

means for generating a reference clock pulse signal;

first timer circuit means connected with said reference clock pulse generating means, for frequency-dividing said reference clock pulse signal to establish a first predetermined period of time;

second timer circuit means connected with said reference clock pulse generating means, for frequency-dividing said reference clock pulse signal to establish a second predetermined period of time; and control circuit means connected with said first and second timer circuit means, for receiving at least a first external input signal indicating the presence of flame generated as a result of the ignition of fuel supplied from said fuel supplying apparatus, said control circuit means delivering a first and a ninth output signal simultaneously, said first output signal being for resetting said reference clock pulse generating means in response to the extinction of said first external input signal during a combustion operation and immediately thereafter setting said reference clock pulse generating means to resume its operation, said ninth output signal being for setting said second timer circuit means to start the frequency-dividing operation for establishing said second predetermined period of time, said control circuit means further delivering a fifth and a second output signal simultaneously at the end of said second predetermined period of time established by said second timer circuit means, said fifth output signal being for actuating said ignitor to operate, said second output signal being for setting said first timer circuit means to start the frequency-dividing operation for establishing said first predetermined period of time, said control circuit means further delivering a third output signal for actuating said alarm to operate unless said first external input signal arrives within said first predetermined period of time, thereby stopping the operations of said fuel supplying apparatus, said blower and said ignitor included in said combustion system.

16. A combustion control apparatus as claimed in claim 15, wherein said control circuit means delivers a fourth signal to actuate said blower to operate in response to a second external signal supplied to said control circuit means, said fifth and second output signals being simultaneously delivered when said second predetermined period of time has lapsed since the commencement of said fourth output signal, said third output signal being delivered unless said first external input signal arrives within said first predetermined period of time.

17. A combustion control apparatus as claimed in claim 16, wherein said fifth output signal is extinguished in response to the reception of said first external input signal by said control circuit means after said fifth output signal has been delivered.

18. A combustion control apparatus as claimed in claim 16, wherein said fifth output signal is extinguished after the lapse of a predetermined time following the delivery of said fifth output signal, on condition that said first external input signal is present.

19. A combustion control apparatus as claimed in claim 16, wherein said fifth output signal is extinguished at the end of said first predetermined period of time.

20. A combustion control apparatus as claimed in claim 17, wherein said control circuit means delivers a sixth signal to stop the operation of said second timer circuit means in response to the reception of said first external input signal by said control circuit means.

21. A combustion control apparatus as claimed in claim 15, wherein said alarm includes means for indicating the occurrence of a fault in said combustion system when actuated by said third output signal.

22. A combustion control apparatus as claimed in claim 16, wherein said control circuit means delivers a seventh output signal to actuate said fuel supplying apparatus to supply fuel in response to said second external input signal.

23. A combustion control apparatus as claimed in claim 22, wherein said seventh output signal is delivered when said second predetermined period of time has lapsed after the commencement of said fourth output signal.

24. A combustion control apparatus as claimed in claim 23, wherein, in response to the arrival of said second external input signal, said control circuit means simultaneously delivers said fourth output signal, an eighth output signal to start the operation of said reference clock pulse generating means, and said ninth output signal.

25. A combustion control apparatus as claimed in claim 15, wherein said control circuit means includes therein a circuit for generating a one-shot pulse having a duration sufficiently shorter than the period of said reference clock pulse signal in response to the extinction of said first external input signal during a combustion operation, said one-shot pulse being supplied as said first output signal to said reference clock pulse generating means.

26. A combustion control apparatus as claimed in claim 25, wherein said one-shot pulse generating circuit is a differentiating circuit.

27. A combustion control apparatus as claimed in claim 25, wherein said one-shot pulse generating circuit is a one-shot multivibrator.

* * * * *